US006872103B1

(12) United States Patent
Flieger et al.

(10) Patent No.: US 6,872,103 B1
(45) Date of Patent: Mar. 29, 2005

(54) BUSHING CONTACT

(75) Inventors: Richard Flieger, Stammham (DE); Freddy D'Hulster, Aartrijke (BE)

(73) Assignee: Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 09/762,138

(22) PCT Filed: Jul. 1, 1999

(86) PCT No.: PCT/DE99/02015

§ 371 (c)(1),
(2), (4) Date: Mar. 29, 2001

(87) PCT Pub. No.: WO00/08721

PCT Pub. Date: Feb. 17, 2000

(30) Foreign Application Priority Data

Aug. 30, 1998 (DE) ..... 198 35 020

(51) Int. Cl.[7] ..... H01R 13/15
(52) U.S. Cl. ..... 439/839; 439/845; 439/752.5
(58) Field of Search ..... 439/752.5, 845, 439/839–862

(56) References Cited

U.S. PATENT DOCUMENTS

| | | | | | |
|---|---|---|---|---|---|
| 3,550,069 | A | * | 12/1970 | Teagno | 439/848 |
| 3,793,616 | A | * | 2/1974 | Moehrke | 439/867 |
| 4,012,106 | A | * | 3/1977 | Filson | 439/732 |
| 4,540,235 | A | | 9/1985 | Lolic | |
| 4,798,545 | A | * | 1/1989 | Roy et al. | 439/677 |
| 4,932,877 | A | | 6/1990 | Zinn | |
| 4,934,965 | A | * | 6/1990 | Buddrus et al. | 439/845 |
| 4,934,966 | A | * | 6/1990 | D'Urso | 439/849 |
| 4,938,720 | A | * | 7/1990 | Romak | 439/839 |
| 4,950,183 | A | * | 8/1990 | Watanabe et al. | 439/843 |
| 5,094,636 | A | | 3/1992 | Zinn et al. | |
| 5,246,390 | A | * | 9/1993 | Egenolf | 439/839 |

(Continued)

FOREIGN PATENT DOCUMENTS

| | | | | |
|---|---|---|---|---|
| DE | 3346322 | * | 7/1985 | 439/849 |
| DE | UM 9201047 | | 6/1993 | |
| DE | 4312641 | | 10/1994 | |
| DE | 19536500 | | 4/1997 | |
| EP | 0099845 | * | 2/1984 | 439/851 |
| WO | WO 99/41807 | * | 8/1999 | H01R/13/18 |

OTHER PUBLICATIONS

Customer Drawings for Tyco Electronics Maxi Power Time; 1 page, from Tyco Electronics website.

Customer Drawings for Tyco Electronics Standard Power Timer; 1 page, from Tyco Electronics website.

Customer Drawings for Tyco Electronics Junior Power Timer; 2 pages, from Tyco Electronics website.

Customer Drawings for Tyco Electronics Micro Power Timer; 2 pages, from Tyco Electronics website.

*Primary Examiner*—Tho D. Ta
*Assistant Examiner*—Larisa Z. Tsukerman
(74) *Attorney, Agent, or Firm*—Baker & Daniels

(57) ABSTRACT

The invention relates to a socket contact (1) including a back-up spring (3) and a base spring (2), the back-up spring (3) enclosing the base spring (2) in box-like manner with a first wall (11), a second wall (12), a third wall (13) and a divided fourth wall (14). The wall sections (14*a*, 14*b*) of the fourth divided wall (14) are connected to each other in positive fitting manner. On one wall section (14*a*), there are formed at least two connecting lugs (23) arranged in the front and rear portions of the wall section (14*a*) as seen in the direction of insertion of the socket contact (1). The other wall section (14*b*) is formed with a recess (24) for each connecting lug (23), and the connecting lugs (23) are passed through the recesses (24) and bent over. For increased stability, the two wall sections (14*a*, 14*b*) overlap over the full length of the back-up spring (3).

20 Claims, 4 Drawing Sheets

U.S. PATENT DOCUMENTS 5,271,741 A * 12/1993 Saito et al. ..... 439/843
5,295,873 A 3/1994 Walbrecht
5,437,566 A 8/1995 Zinn et al.
5,525,070 A * 6/1996 Axelsson ..... 439/268
5,624,273 A * 4/1997 Myer ..... 439/399
5,643,018 A * 7/1997 Sakai et al. ..... 439/852
5,664,972 A 9/1997 Zinn et al.
5,775,962 A * 7/1998 Kakuta et al. ..... 439/852
5,810,627 A * 9/1998 Gierut et al. ..... 439/843
5,863,225 A 1/1999 Liebich et al.
5,921,821 A * 7/1999 Oka et al. ..... 439/845
5,954,548 A * 9/1999 Stabroth ..... 439/839
6,126,495 A 10/2000 Lolic et al.
6,394,858 B1 * 5/2002 Geltsch ..... 439/852

* cited by examiner

BUSHING CONTACT

BACKGROUND OF THE INVENTION

The invention relates to a socket contact consisting of a back-up spring and a base spring, the back-up spring enclosing the base spring in box-like manner with a first, second, third and a divided fourth wall, and with at least two connecting lugs being formed on one wall section for connecting the wall sections of the fourth divided wall to each other in positive manner, said connecting lugs, in the direction of insertion of said socket contact, being formed in the front and rear portions of the wall sections.

SUMMARY OF THE INVENTION

Such a back-up spring is known from DE 195 36 500 C2. The back-up spring is made of a stamped and bent part, with the two top wall sections being separated from each other by a longitudinal slot for manufacturing reasons. One of the top wall sections, in the lower partial region of the longitudinal slot, is formed with a connecting lug that is bent upwardly from the top wall section by a cranked portion and extends beyond the longitudinal slot in the direction towards the opposite top wall section and overlaps the other top wall section. The connection of the connecting lug to the other top wall section takes place either by plastic forming, i.e. plastic cold forming and pressing the connecting portion into each other using a punch, or by welding or by a completely positive connection. The publication does not suggest a concrete positive connection of the top wall sections.

DE 43 12 641 A1 discloses an electric contact bushing comprising a back-up spring in which the back-up spring also has a longitudinal slot in its bottom wall for manufacturing reasons. The bottom wall sections have abutment edges which extend in parallel along the longitudinal slot and which are not aligned in the front region of the contact bushing but rather establish a hook-type design.

This kind of positive connection, however, has the disadvantage that the hook-type connection may be released in case of strong torsion or mechanical load of the back-up spring.

Furthermore, DE-UM 92 01 047 discloses a double flat spring contact comprising a back-up spring integrally incorporated in the contact and formed in one piece with the same. The base part of this contact is divided, with the thus formed side walls being connected to each other with stability in terms of shape via two connecting lugs. The connecting lugs have a recess and a dovetail-like projection, respectively, that is wedged into said recess.

This type of connection also entails the disadvantage that it may become released in case of torsion or strong mechanical loads acting on the back-up spring.

It is thus the object of the invention to indicate for a socket contact of the type indicated at the outset a back-up spring having an as stable as possible closed box-shape that can be manufactured without additional working expenditure.

This object is met according to the invention in that the other wall section is formed with a recess for each connecting lug and that the connecting lugs are passed through the recesses and bent over, and the two wall sections overlap over the full, length of the back-up spring.

This type of connection can easily be produced on a stamping and bending machine. The connecting lugs to this end are bent over first by 90° so that they protrude outwardly. Thereafter, the other wall section with the recesses is bent over the protruding connecting lugs such that the connecting lugs extend through the recesses. By bending over the upper portion of the connecting lugs, the wall halves of the divided fourth wall are connected to each other with stability in shape.

Due to the fact that the wall halves overlap over the entire length of the back-up spring, a closed box-shape is obtained and the stability of the connection is increased considerably. By said overlapping, the upper wall section is clamped between the bent portion of the connecting lugs and the lower wall section. The clamping effect adds a frictional component to the positive connection.

The wall halves thus are firmly connected to each other both in the longitudinal and in the transverse direction of the back-up spring. Also in case of high mechanical loads, such as e.g. torsion or stepping-on loads of the back-up spring, there is thus no risk that the connection of the wall halves will become disengaged.

The recesses preferably are formed in the upper wall section in the form of elongate holes. At least one recess, however, may also be formed as U-shaped recess on the terminal-side or contact-side edge of the upper wall section.

The provision of the recesses in the form of elongate holes has the advantage that the connecting lugs, after bending, can be formed into a shape such that they are supported on the walls of the recesses.

The deformation of the connecting lugs suitably takes place by pressing together or introducing one or more notches on the upper side of the connecting lugs.

To enclose the base spring in as stable manner as possible, it is necessary to keep the contact area between back-up spring and base spring as large as possible. To this end, the upper wall section, in front of the overlapping portion, is advantageously formed with a crank with the material thickness of the lower wall section.

Further advantageous developments are indicated in the dependent claims.

BRIEF DESCRIPTION OF THE DRAWINGS

The invention will be elucidated in more detail hereinafter by way of an embodiment depicted in the drawings, in which.

DETAILED DESCRIPTION OF THE DRAWINGS

Figure 1:
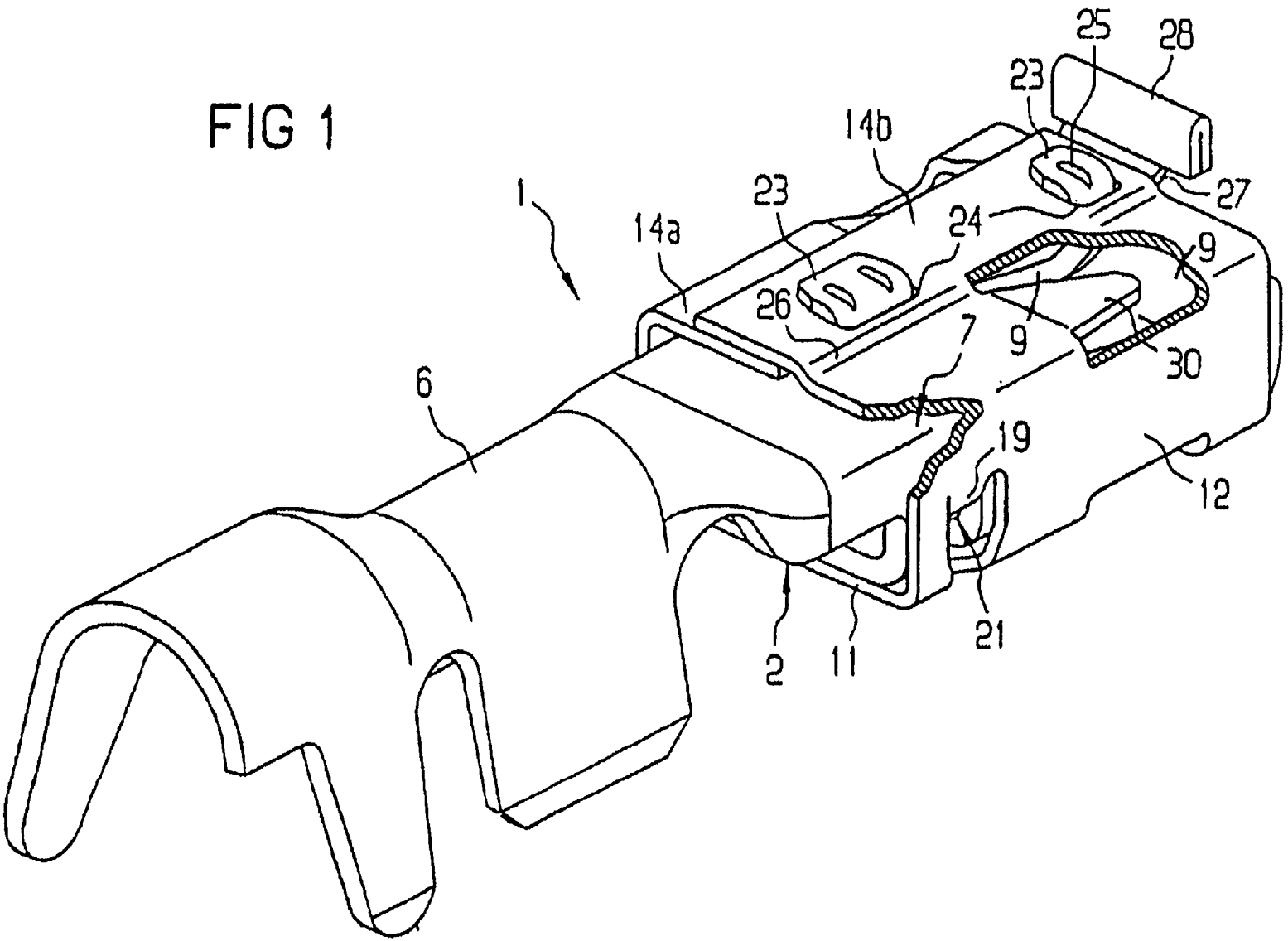
FIG. 1 shows a perspective view of a socket contact looking onto the divided fourth wall.
Figure 2:
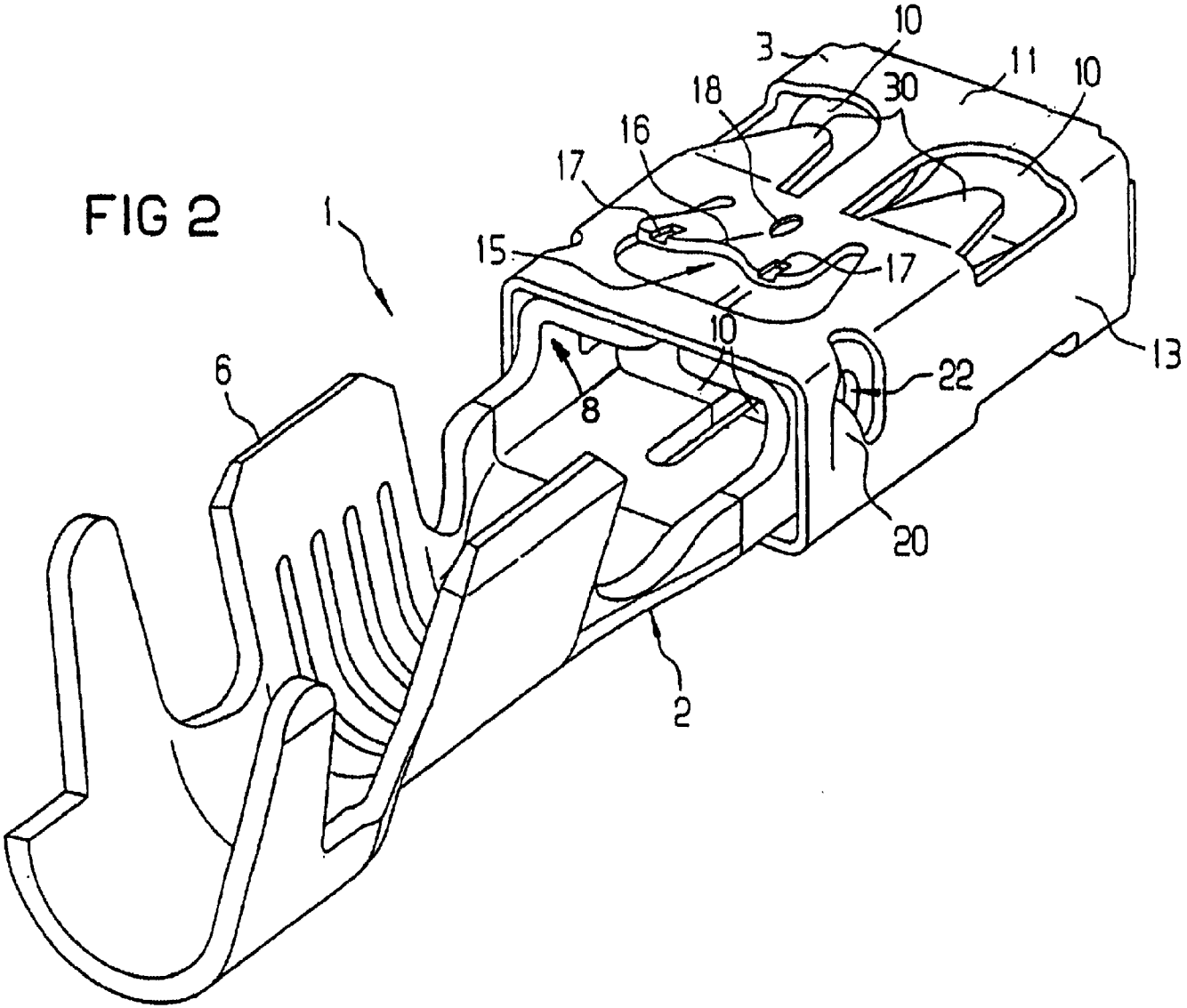
FIG. 2 shows a corresponding view of the socket contact looking onto the first wall.

FIGS. 1 and 2 illustrate a socket contact 1 consisting of a base spring 2 and a back-up spring 3. The entire socket contact 1 is inserted into a contact cavity 4 of a contact carrier 5 (cf. FIG. 4), e.g. a socket housing of an electrical connector assembly with single-row or multi-row contact cavities. The base spring 2 is formed with a terminal section 6, e.g. in the form of a crimp-type terminal, for an electric conductor and with a contact section 7 having a spring leg base 8 of e.g. U-shaped or rectangular design in cross-section, from which extend the spring legs 9 and 10 (cf. FIG. 5) for establishing contact with a plug-type contact, e.g. a contact blade. The spring legs 9 and 10 of the base spring 2 originate, in the disclosed embodiment, from the top and bottom wall of a spring leg base 8 of rectangular cross-section. The spring legs may be designed as ordinary forked spring arms or double flat spring contacts, but may also have a plurality of contact lamellas on each spring leg by providing longitudinal slots. In case of the socket contact 1 illustrated, each spring leg 9, 10 has four contact lamellas.

The back-up spring 3 also is of rectangular cross-section so that it encloses the entire contact section 7 of the base spring 2 with four walls 11 to 14 in box-shaped manner. The first wall 11 constitutes the top wall, the second and third walls 12, 13 constitute the side walls, and the fourth wall 14 represents the bottom wall. In the lower partial region of the first wall 11 facing the terminal section 6 of base spring 2, there is formed an outwardly bent locking hook 15 as primary locking feature for a socket contact 1 to be inserted into a contact cavity 4 of contact carrier 5. Locking hook 15, on its outer face side in the middle thereof, has an outwardly projecting bulge 16 and is provided with an impressed portion 17 on both sides of the bulge 16. Due to the impressed portions 17, there are formed relatively sharp edges on the face side of locking hook 15 which contribute in that the locking hook 15 provides for better fixation of the socket contact 1 in the contact cavity 4. The outwardly directed bulge 16 in locking hook 15 also contributes in providing improved fixation of socket contact 1 in contact cavity 4.

For providing the effect that the looking hook 15 is pressed against the inner wall of contact cavity 4 as strongly as possible, there is provided a reinforcing bead 18 in the bending line between the locking hook 15 and the first wall 11. The reinforcing bead 18 aggravates bending back of the looking hook 17 towards tie first wall 11.

For fixing the back-up spring 3 on the base spring 2, the second and third walls 12, 13 of back-up spring are formed with folding lugs 19, 20 formed by separating cuts, which engage in corresponding openings 21, 22 the side walls of the spring leg base 8.

The base spring 2 and the back-up spring 3 are stamped and bent sheet metal members and thus are divided into two in one wall for manufacturing reasons.

In case of back-up spring 3, the fourth wall 14 is divided into two and consists of the two wall sections 14*a* and 14*b*. For obtaining a stable closed box-shape, the wall sections 14*a* and 14*b* are connected to each other in the manner elucidated hereinafter.

The wall sections 14*a* and 14*b* overlap over the entire length of back-up spring 3. Due to such overlapping, there is formed a lower wall section 14*a* and an upper wall section 14*b*. The lower wall section 14*a* has two connecting lugs 23 formed thereon which are bent upwardly by 90° and are passed through corresponding recesses 24 in the upper wall section 14*b*. For providing a positive or form-fit connection of the wall sections 14*a* and 14*b*, the connecting lugs 23, after having been passed through the recesses 24, are bent over once more by 90° so that the upper wall section 14*a* is clamped between the bent over upper portion of the connecting lugs 23 and the lower wall section 14*a*.

In bending over the upper portion of the connecting lugs 23, these are press-fit such that the connecting lugs 23 are urged against the side walls of opening 24. By doing so, any possibility of movement of the wall sections 14*a* and 14*b* relative to each other is excluded after press-fitting. In addition to or as an alternative to press-fitting, the top sides of the bent over connecting lugs 23 may be provided with notches 25 so that the connecting lugs become broader in the longitudinal direction of the back-up spring 3 and are also pressed against the side walls of the recesses 24. The notches 25 are arranged perpendicularly to the longitudinal direction of the back-up spring 3.

The two connecting lugs 23, through which wall sections 14*a* and 14*b* are connected to each other, are arranged substantially in the front and rear portions of the lower wall section 14*a* as seen in the direction of insertion of socket contact 1.

The connecting lug 23 located closer to the terminal section 6 of the base spring 2 is of considerably broader configuration and is provided on the top side thereof with two or more notches 25.

In order for the back-up spring 3 to enclose the rectangular base spring 2 almost completely, the upper wall section 14*b* is bent by a crank 26 in front of the portion overlapping with the lower wall section 14*a*.

Figure 4:
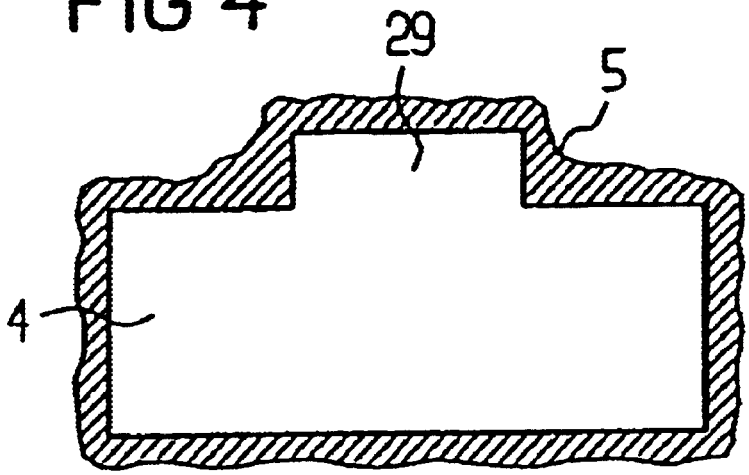
FIG. 4 shows a cross-sectional view of a contact cavity of a contact carrier receiving a socket contact.

On the face side of the lower wall section 14*a* facing in insertion direction, there is arranged an additional lug 27 that is also bent upwardly by 90°, and the somewhat broader upper portion thereof is folded back downwardly by 180°. The upper folded portion of lug 27 constitutes a polarizing member 28 for the socket contact 1, so as to prevent erroneous insertion of the socket contact into the contact cavity of a contact carrier. Lug 27 is laterally offset from the longitudinal axis of the back-up spring 3. The upper folded portion is broadened in the direction towards the longitudinal axis of the backup spring 3, but still is arranged laterally offset from the longitudinal axis of the back-up spring 3. However, it may also be arranged centrally with respect to the longitudinal axis of the back-up spring 3 so as to be matable with the contact cavity 4 as shown in FIG. 4. As shown by the sectional view in FIG. 4, the contact cavity 4 of contact carrier 5 is formed with a corresponding polarizing groove 29 for polarizing member 28.

In order to not hinder insertion of socket contact 1 into the contact cavity 4 of contact carrier 5, the dimensions of polarizing member 28 transversely of the direction of insertion are smaller than those of the polarizing groove 29.

Figure 5:
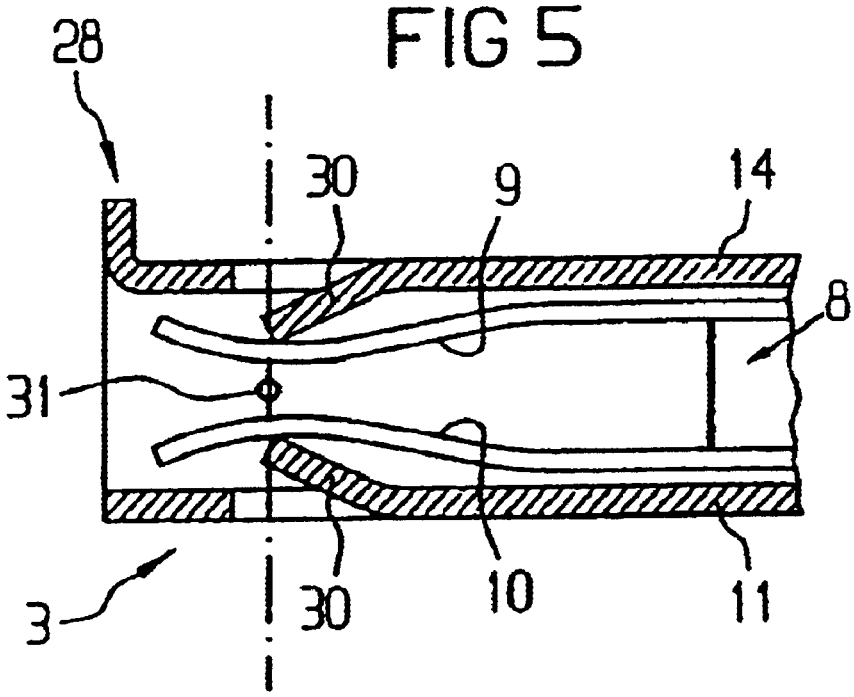
FIG. 5 shows a partial sectional view of the contact region of the socket contact.

On the divided fourth wall 14 and on the first wall 11 of the back-up spring 3, there is formed, for each spring leg 9, 10 of the back-up spring 3, an inwardly bent back-up spring tongue 30 which abut on the spring legs 9, 10 approximately at the height of the contact region 31 (cf. FIG. 5).

Figure 3:
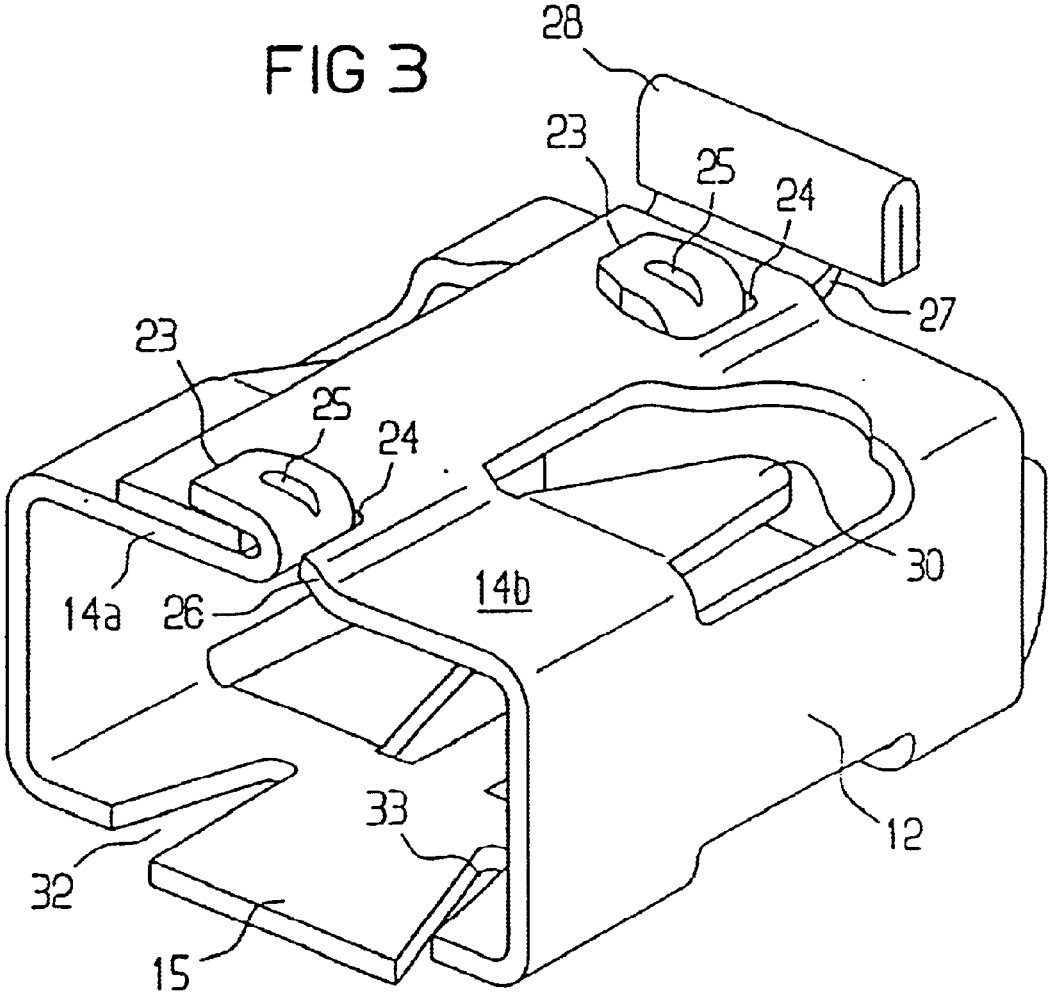
FIG. 3 shows a perspective view of a further modification of the back-up spring looking onto the divided fourth wall.

FIG. 3 shows an additional modification of the back-up spring 3. The connection of wall sections 14*a* and 14*b* is effected both on the terminal side and on the contact side via two connecting lugs 23 of equal width, which are provided with only one impressed portion 25 each on their top side. The terminal-side recess 24 in upper wall section 14*a* is of U-shaped configuration. The locking hook 15 is formed on the terminal-side edge of the first wall 11 and is produced by two cuts 32, 33 starting from the face side of the first wall 11 that is directed towards terminal section 6.

What is claimed is:

1. A socket contact comprising a base spring and a discrete backup spring, said base spring comprised of at least two opposed contact portions attached to a conductor connecting portion, said backup spring enclosing the base spring in box-like manner with a first wall, a second wall, a third wall, and divided fourth wall, and with at least two connecting lugs being formed on one wall section for connecting the wall sections of the divided fourth wall to each other in positive manner, said connecting lugs being arranged in the front and rear portions of the wall section as seen in the direction of insertion of the socket contact, the other wall section is formed with a recess for each connecting lug and said connecting lugs are passed through the recesses and bent over, and the two wall sections overlap over the full length of the backup spring, said backup spring further comprising backup spring arms positioned proximate to said opposed contact portions in an overlying manner.

2. The socket contact of claim 1, wherein a lower wall section and an upper wall section are formed by said overlapping of the wall sections of the backup spring, and the connecting lugs are formed on the lower wall section and the recesses are formed on the upper wall section.

3. The socket contact of claim 2, wherein at least one recess is formed as an elongate hole in the upper wall section.

4. The socket contact of claim 2, wherein at least one recess is formed as U-shaped recess on the terminal-side or contact-side edge of the upper wall section.

5. The socket contact of claim 2, wherein the upper wall section, in front of said overlapping portion, has a crank with the material thickness of the lower wall section.

6. The socket contact of claim 2, wherein the lower wall section is formed with a polarizing member.

7. The socket contact of claim 1, wherein the connecting lugs, after being bent over, are deformed such that they are supported on the walls of the recesses.

8. The socket contact of claim 7, wherein the deformation of the connecting lugs is effected by press-fitting or introducing one or more notches on the upper side of the connecting lugs.

9. The socket contact of claim 1, wherein a locking hook extending in the longitudinal direction of the backup spring is cut out and bent outwardly from the first wall.

10. The socket contact of claim 1, wherein, for mounting the backup spring on the base spring, there are formed folding lugs on the opposing second and third walls of the backup spring, with said folding lugs being adapted to be bent inwardly and engaging in corresponding openings on the base spring.

11. A socket contact comprising a base spring and a discrete backup spring, said base spring comprised of at least two opposed contact portions attached to a conductor connecting portion, said backup spring consisting of a different metal than said base spring and enclosing the base spring in box-like manner with a first wall, a second wall, a third wall, and a divided fourth wall comprised of overlapping wall portions, and with at least two connecting lugs being formed on one of said overlapping wall portions and complementary recesses being formed in said other overlapping wall portion, said connecting lugs being passed through the recesses and bent over for connecting the wall sections of the divided fourth wall to each other in positive manner, said connecting lugs being arranged in the front and rear portions of the wall section as seen in the direction of insertion of the socket contact, said backup spring further comprising backup spring arms positioned proximate to said opposed contact portions in an overlying manner.

12. The socket contact of claim 11, wherein a lower wall section and an upper wall section are formed by said overlapping of the wall sections of the backup spring, and the connecting lugs are formed on the lower wall section and the recesses are formed on the upper wall section.

13. The socket contact of claim 12, wherein at least one recess is formed as an elongate hole in the upper wall section.

14. The socket contact of claim 12, wherein at least one recess is formed as U-shaped recess on the terminal-side or contact-side edge of the upper wall section.

15. The socket contact of claim 12, wherein the upper wall section, in front of said overlapping portion, has a crank with the material thickness of the lower wall section.

16. The socket contact of claim 12, wherein the lower wall section is formed with a polarizing member.

17. The socket contact of claim 11, wherein the connecting lugs, after being bent over, are deformed such that they are supported on the walls having the recesses.

18. The socket contact of claim 17, wherein the deformation of the connecting lugs is effected by press-fitting or introducing one or more notches on the upper side of the connecting lugs.

19. The socket contact of claim 11, wherein a locking hook extending in the longitudinal direction of the backup spring is cut out and bent outwardly from the first wall.

20. The socket contact of claim 11, wherein, for mounting the backup spring on the base spring, there are formed folding lugs on the opposing second and third walls of the backup spring, with said folding lugs being adapted to be bent inwardly and engaging in corresponding openings on the base spring.

* * * * *